US009293129B2

(12) United States Patent
Zhao et al.

(10) Patent No.: US 9,293,129 B2
(45) Date of Patent: Mar. 22, 2016

(54) SPEECH RECOGNITION ASSISTED EVALUATION ON TEXT-TO-SPEECH PRONUNCIATION ISSUE DETECTION

(71) Applicant: Microsoft Technology Licensing, LLC, Redmond, WA (US)

(72) Inventors: Pei Zhao, Beijing (CN); Bo Yan, Beijing (CN); Lei He, Beijing (CN); Zhe Geng, Beijing (CN); Yiu-Ming Leung, Beijing (CN)

(73) Assignee: Microsoft Technology Licensing, LLC, Redmond, WA (US)

( * ) Notice: Subject to any disclaimer, the term of this patent is extended or adjusted under 35 U.S.C. 154(b) by 151 days.

(21) Appl. No.: 13/785,573

(22) Filed: Mar. 5, 2013

(65) Prior Publication Data

US 2014/0257815 A1 Sep. 11, 2014

(51) Int. Cl.
*G10L 13/08* (2013.01)

(52) U.S. Cl.
CPC ..... *G10L 13/086* (2013.01); *G10L 13/08* (2013.01)

(58) Field of Classification Search
None
See application file for complete search history.

(56) References Cited

U.S. PATENT DOCUMENTS

| | | | | |
|---|---|---|---|---|
| 5,842,163 | A | 11/1998 | Weintraub | |
| 6,181,351 | B1 | 1/2001 | Merrill et al. | |
| 6,985,865 | B1 * | 1/2006 | Packingham et al. | 704/275 |
| 7,181,398 | B2 | 2/2007 | Thong et al. | |
| 7,437,294 | B1 * | 10/2008 | Thenthiruperai | 704/270.1 |
| 7,529,670 | B1 | 5/2009 | Michaelis | |
| 8,175,879 | B2 | 5/2012 | Nitisaroj et al. | |
| 8,355,915 | B2 | 1/2013 | Rao | |
| 2003/0187643 | A1 | 10/2003 | Van Thong et al. | |
| 2007/0016421 | A1 * | 1/2007 | Nurminen et al. | 704/260 |
| 2008/0300874 | A1 | 12/2008 | Gavalda et al. | |
| 2009/0006097 | A1 | 1/2009 | Etezadi et al. | |

(Continued)

FOREIGN PATENT DOCUMENTS

WO 2007/007256 A1 1/2007

OTHER PUBLICATIONS

McGraw, et al., "Learning Lexicons from Speech Using a Pronunciation Mixture Model", In IEEE Transactions on Audio, Speech and Language Processing, vol. 21, Issue 2, Feb. 2013, 10 pages.

(Continued)

*Primary Examiner* — Jeremiah Bryar
(74) *Attorney, Agent, or Firm* — Danielle Johnston Holmes; Steven Spellman; Micky Minhas

(57) ABSTRACT

Pronunciation issues for synthesized speech are automatically detected using human recordings as a reference within a Speech Recognition Assisted Evaluation (SRAE) framework including a Text-To-Speech flow and a Speech Recognition (SR) flow. A pronunciation issue detector evaluates results obtained at multiple levels of the TTS flow and the SR flow (e.g. phone, word, and signal level) by using the corresponding human recordings as the reference for the synthesized speech, and outputs possible pronunciation issues. A signal level may be used to determine similarities/differences between the recordings and the TTS output. A model level checker may provide results to the pronunciation issue detector to check the similarities of the TTS and the SR phone set including mapping relations. Results from a comparison of the SR output and the recordings may also be evaluation by the pronunciation issue detector. The pronunciation issue detector outputs a list that lists potential pronunciation issue candidates.

20 Claims, 8 Drawing Sheets

(56) References Cited

U.S. PATENT DOCUMENTS

| | | | | |
|---|---|---|---|---|
| 2009/0099847 | A1 | 4/2009 | Soong et al. | |
| 2009/0228273 | A1 | 9/2009 | Wang et al. | |
| 2009/0292538 | A1 | 11/2009 | Barnish et al. | |
| 2009/0299724 | A1 * | 12/2009 | Deng et al. | 704/2 |
| 2010/0304342 | A1 | 12/2010 | Zilber | |
| 2014/0025381 | A1 | 1/2014 | Wang et al. | |

OTHER PUBLICATIONS

Wang, et al., "Automatic Generation and Pruning of Phonetic Mispronunciations to Support Computer-Aided Pronunciation Training", In 9th Annual Conference of the International Speech Communication Association, Sep. 22, 2008, 4 pages.

Galescu, Lucian, "Extending Pronunciation Lexicons via Non-phonemic Respellings", In Proceedings of Human Language Technologies: The Annual Conference of the North American Chapter of the Association for Computational Linguistics, May 31, 2009, 4 pages.

Hoffmann, et al., "Analysis of Verbal and Nonverbal Acoustic Signals with the Dresden UASR System", In Proceedings of the COST Action International Conference on Verbal and Nonverbal Communication Behaviours, Mar. 29, 2007, 337 pages.

"International Search Report & Written Opinion for PCT Patent Application No. PCT/US2014/019149", Mailed Date: Jun. 2, 2014, Filed Date: Feb. 27, 2014, 9 Pages.

Hamada, et al., "Automatic Evaluation of English Pronunciation based on Speech Recognition Techniques", In IEICE Transactions on Information and Systems, Information and Systems Society, Tokyo, JP, vol. E76-D, No. 3, Mar. 1, 1993, pp. 352-359.

Lo, et al., "Generalized Posterior Probability for Verifying Recognized Words Optimally in Microphone Array Applications", Retrieved on: Jan. 23, 2012, Available at: http://citeseerx.isl.psu.edu/viewdoc/download?doi=10.1.1.148.4907&rep=rep1&type=pdf.

PCT International Search Report & Written Opinion for PCT Patent Application No. PCT/US2013/050969, Mailed Date: Oct. 8, 2013, Filed Date: Jul. 18, 2013, 12 Pages.

Pitrelli, et al., "The IBM Expressive Text-to-speech Synthesis System for American English", In IEEE Transactions on Audio, Speech and Language Processing, vol. 14, No. 4, July 2006, pp. 1099-1108.

U.S. Appl. No. 13/554,480, Amendment and Response filed Jan. 12, 2015, 11 pgs.

U.S. Appl. No. 13/554,480, Amendment and Response filed Jun. 4, 2015, 10 pgs.

U.S. Appl. No. 13/554,480, Office Action mailed Oct. 10, 2014, 9 pgs.

U.S. Appl. No. 13/554,460, Office Action mailed Mar. 11, 2015, 10 pgs.

U.S. Appl. No. 13/554,480, Office Action mailed Jun. 18, 2015, 10 pgs.

Wang, et al., "Auto-Checking Speech Transcriptions by Multiple Template Constrained Posterior", In 10th Annual Conference of the International Speech Communication Association, Sep. 6, 2009, 4 Pages.

Wang, et al., "Objective Intelligibility Assessment of Text-to-Speech System Using Template constrained Generalized Posterior Probability", In 13th Annual Conference of the International Speech Communication Association, Sep. 9, 2012, 4 Pages.

Wang, et al., "Phonetic Transcription Verification with Generalized Posterior Probability", In Interspeech, Sep. 4-8, 2005, pp. 1949-1952.

Wang, et al, "Template Constrained Posterior for Verifying Phone Transcriptions", In IEEE International Conference on Acoustics, Speech and Signal Processing, Mar. 31-Apr. 4, 2008, pp. 4681-4684.

Wessel, et al. "Confidence Measures for Large Vocabulary Continuous Speech Recognition", In IEEE Transactions on Speech and Audio Processing, vol. 9, No. 3, Mar. 2001, pp. 288-298.

European Official Communication in Application 147101786, mailed Oct. 13, 2015, 2 pgs.

* cited by examiner

SPEECH RECOGNITION ASSISTED EVALUATION ON TEXT-TO-SPEECH PRONUNCIATION ISSUE DETECTION

BACKGROUND

Text-to-Speech (TTS) systems are becoming increasingly popular. The TTS systems are used in many different applications such as navigation, voice activated dialing, help systems, banking and the like. TTS applications use output from a TTS synthesizer according to definitions provided by a developer. TTS systems are evaluated by human listening test for labeling errors (e.g. pronunciation errors) which can be costly and time consuming.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Pronunciation issues for synthesized speech are automatically detected using human recordings as a reference within a Speech Recognition Assisted Evaluation (SRAE) framework including a Text-To-Speech flow and a Speech Recognition (SR) flow. A pronunciation issue detector evaluates results obtained at multiple levels of the TTS flow and the SR flow (e.g. phone, word, and signal level) by using the corresponding human recordings as the reference for the synthesized speech, and outputs results that list possible pronunciation issues. A signal level (e.g. signal level for phone sequences) may be used to determine similarities/differences between the human recorded speech and the TTS output. A model level checker may provide results to the pronunciation issue detector to check the similarities of the TTS and the SR phone set including mapping relations. Results from a comparison of the SR output and the recordings may also be evaluation by the pronunciation issue detector. The pronunciation issue detector uses the different level evaluation results to output possible pronunciation issue candidates.

DETAILED DESCRIPTION

Figure 1:
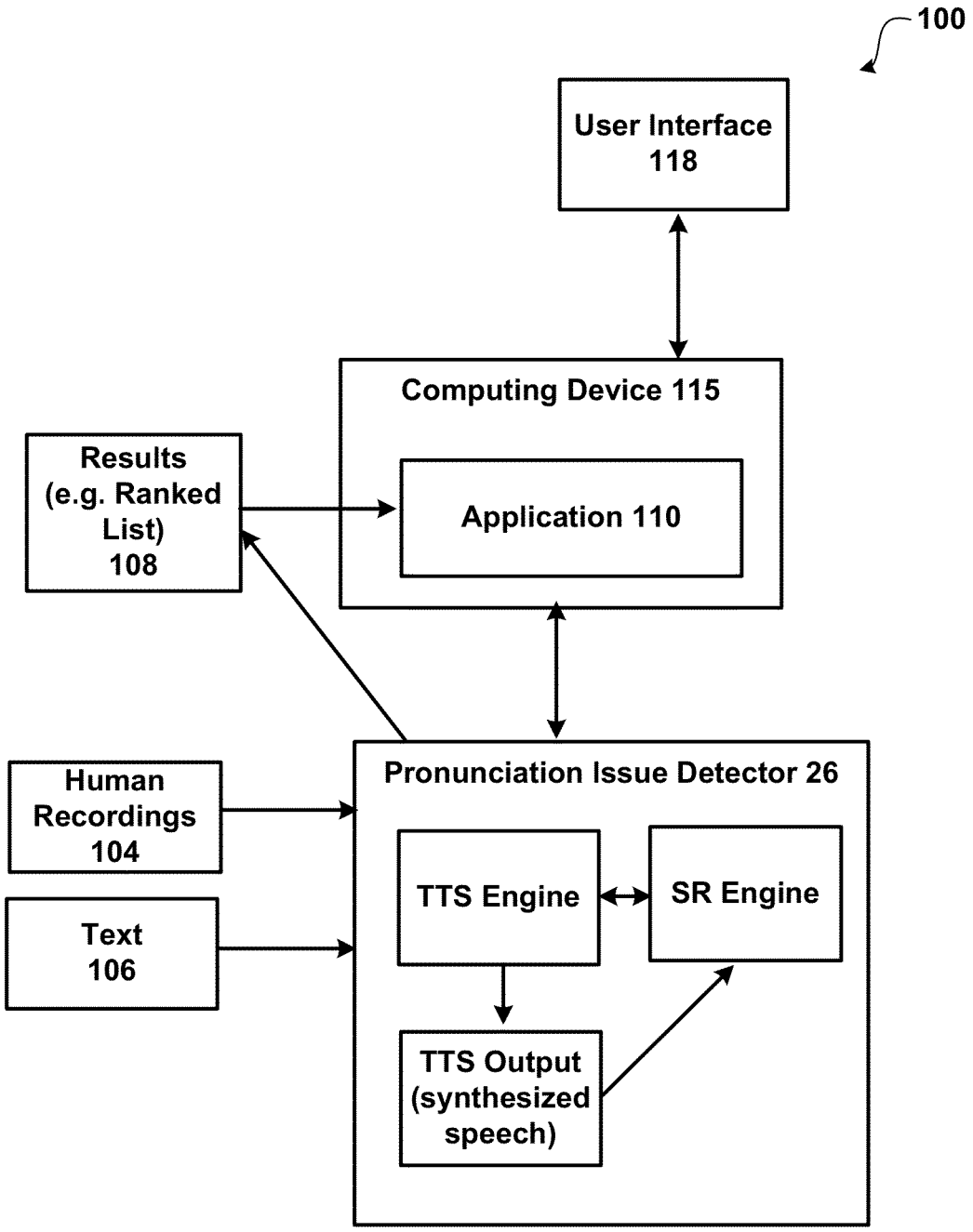
FIG. 1 shows a system including a pronunciation issue detector.

Referring now to the drawings, in which like numerals represent like elements, various embodiment will be described.

FIG. 1 shows a system including a pronunciation issue detector. As illustrated, system 100 includes computing device 115, pronunciation issue detector 26, human recordings 104, text 106, results 108, and User Interface (UI) 118.

System 100 as illustrated may comprise zero or more touch screen input device/display that detects when a touch input has been received (e.g. a finger touching or nearly teaching the touch screen). Any type of touch screen may be utilized that detects a user's touch input. For example, the touch screen may include one or more layers of capacitive material that detects the touch input. Other sensors may be used in addition to or in place of the capacitive material. For example, Infrared (IR) sensors may be used. According to an embodiment, the touch screen is configured to detect objects that are in contact with or above a touchable surface. Although the term "above" is used in this description, it should be understood that the orientation of the touch panel system is irrelevant. The term "above" is intended to be applicable to all such orientations. The touch screen may be configured to determine locations of where touch input is received (e.g. a starting point, intermediate points and an ending point). Actual contact between the touchable surface and the object may be detected by any suitable means, including, for example, by a vibration sensor or microphone coupled to the touch panel. A non-exhaustive list of examples for sensors to detect contact includes pressure-based mechanisms, micromachined accelerometers, piezoelectric devices, capacitive sensors, resistive sensors, inductive sensors, laser vibrometers, and LED vibrometers. One or more recording devices may be used to detect speech and/or video/pictures (e.g. MICROSOFT KINECT, microphone(s), and the like). One or more speakers may also be used for audio output (e.g. TTS synthesized speech).

According to one embodiment, application 110 is an application that is configured to receive results 108 determined by pronunciation issue detector 26. Application 110 may use different forms of input/output. For example, speech input, keyboard input (e.g. a physical keyboard and/or SIP), text input, video based input, and the like may be utilized by application 110. Application 110 may also provide multimodal output (e.g. speech, graphics, vibrations, sounds, . . . ).

Pronunciation issue detector 26 may provide information to/from application 110 in response to analyzing pronunciation issues for a TTS engine. Generally, pronunciation issue detector 26 determines possible pronunciation issues for synthesized speech generated by the TTS engine using evaluations performed at multiple levels. The pronunciation issue detector 26 evaluates results obtained at multiple levels of the TTS flow and the SR flow (e.g. phone, word, and signal level) by using the corresponding human recordings 104 as the reference for the synthesized speech generated from text 106, and outputs results 108 that list possible pronunciation issues. A signal level (e.g. signal level for phone sequences) may be used to determine similarities/differences between the human recorded speech and the TTS output. A model level checker may provide results to the pronunciation issue detector to check the similarities of the TTS and the SR phone set including mapping relations. Results from a comparison of the SR output and the recordings may also be evaluation by the pronunciation issue detector. The pronunciation issue detector uses the different level evaluation results to output possible pronunciation issue candidates as results 108 that may be used by a user to adjust parameters of the TTS engine. More details are provided below.

Figure 2:
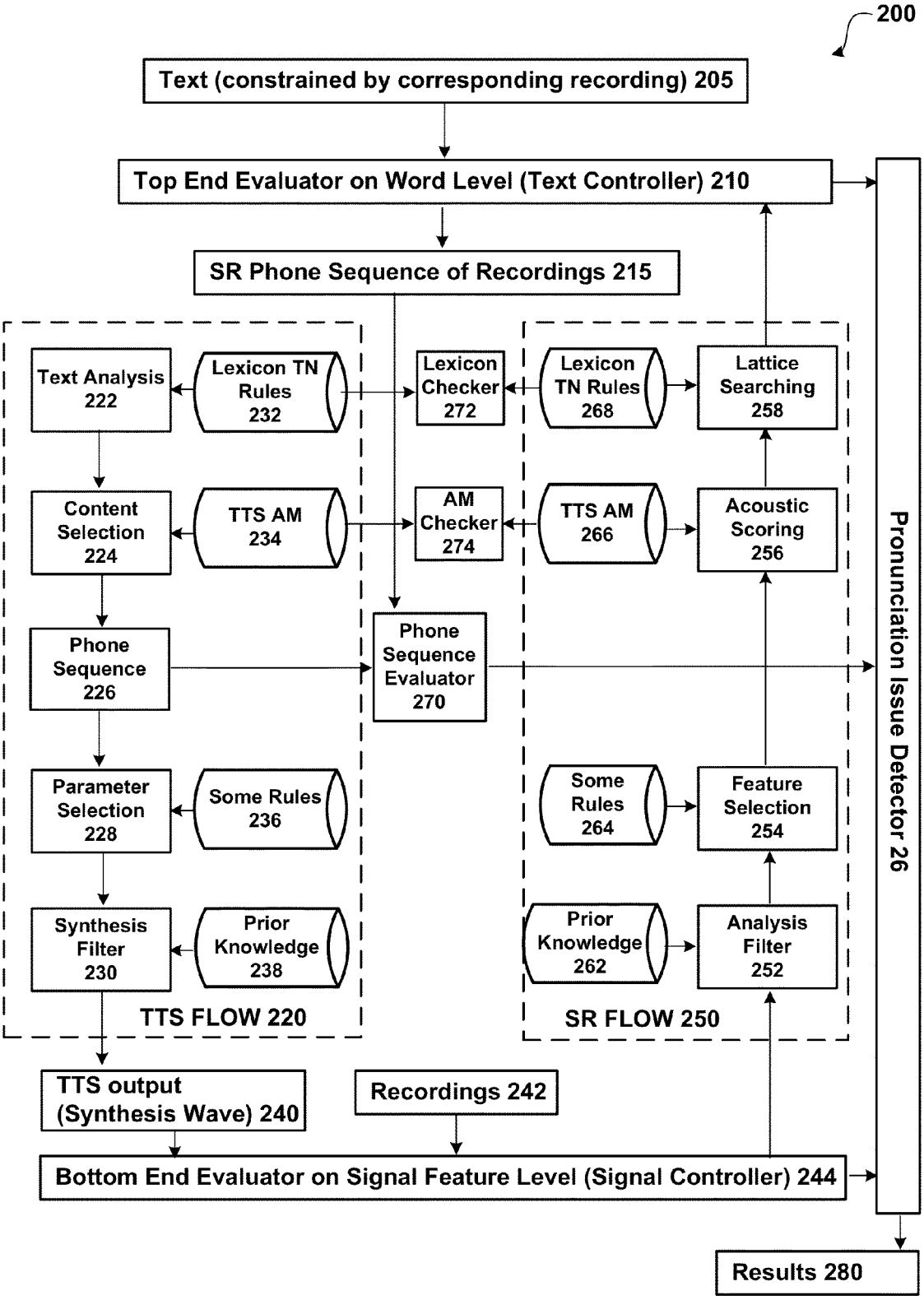
FIG. 2 shows a Speech Recognition Assisted Evaluation (SRAE) framework.

FIG. 2 shows a Speech Recognition Assisted Evaluation (SRAE) framework. As illustrated, SRAE comprises text 205, top end evaluator 210, SR phone sequence of recordings 215, TTS flow 220, SR flow 250, TTS output 240, recordings 242, bottom end evaluator 244, results 280 and pronunciation issue detector 26.

Text-To-Speech (TTS) and Speech Recognition (SR) are functions of a human-machine speech interface. Pronunciation issue detector 26 uses both TTS and SR for automatically determining pronunciation issues. Generally, SR technologies are configured to recognize speech for a variety of users/environments but are not designed for recognizing TTS output. On the other hand, TTS is the inverse process of SR for high level function, but not for the sub-functions. On the sub-functions, TTS has the guidance for a specific voice and style to create synthesized speech.

SRAE Framework 200 is directed at automatically determining potential pronunciation issues of a TTS engine. Instead of using humans for evaluating the TTS system, SRAE framework 200 is directed at saving the cost and time used for human listening tests of the synthesized speech. SRAE framework 200 uses recordings 242 (e.g. human recording of text 205) as a reference that is compared to the TTS output 240 (e.g. synthesized wave) when determining pronunciation issues. Pronunciation issue detector 26 uses results determined at multiple levels of the TTS flow and the SR flow (e.g. phone, word, and signal level) by using the corresponding recordings (242, 215) as the reference for the synthesized speech of the input text 205, and outputs results 280 that list possible pronunciation issues.

As illustrated, TTS flow 220 illustrates steps from input text 205 to the TTS output 240. SR flow 250 shows speech recognition steps from speech signals 244 to recognized text determined from the SR flow.

SRAE framework 200 is directed at detecting potential pronunciation issues by comparing the synthesized speech and the recordings at multiple levels (e.g. text levels and signal level). According to an embodiment, text levels includes the word sequence and the phone sequence. The signal level includes the acoustic feature f0. The text 205 (constrained by the corresponding recordings 242) is used as the test set for pronunciation issue detection. The text 205 is the text script(s) and recordings 242 and SR phone sequence recordings 215 are the corresponding human recordings. In text level detectors, sentence is the largest scale for detection statistic, and the followed by segment which means the continuous words who have the same labels and their neighbors, words in segment, syllables in word, and phones in syllable Pronunciation issue detector 26 may compare the results determined using acoustic features on signal level by comparing the synthesized speech output from TTS flow and the recordings 242. Using the constrained text may assist in removing errors from the SR engine by adjusting for the mismatch between the recognized text of the synthesized speech and the input text by comparing the similarity of the recognized text between synthesized speech and the corresponding recording.

Pronunciation issue detector 26 evaluates the results determined from evaluations for similarities at different levels including at the text level. According to an embodiment, the text levels include the word sequence and phone sequence for each sentence. The comparisons for evaluation on the text include the recognized results of the synthesized speech, the recognized results of the corresponding recordings, and the input text for synthesized speech. According to an embodiment, detection modules of the text levels are based on the Dynamic Programing (DP) algorithm as discussed by B. Richard in the Princeton University Press (1957) for the label sequences alignment by comparing the recognized text sequence with the reference ones, and also comparing the recognized text sequences of synthesized speech and recordings both on phone and word levels.

For each text level, an evaluation is performed that measures the similarity of the target and reference based on the DP alignment results in the sentence as Eq. (1).

$$s = 1 - \frac{C_{Sub} + C_{Ins}}{C_{Corr} + C_{Sub} + C_{Del}}$$

where s is the similarity score on this level evaluator; $C_{Corr}$, $C_{Sub}$, $C_{Ins}$ and $C_{Del}$ denote the counts of correct components, substitution errors, insertion errors, and deletion errors in the sentence. The potential issue counts in each sentence have the high correlation with this score.

According to an embodiment, for text level detection, the phone level is the basic unit compared in the evaluation. For signal level, the signal level detection steps are based on the phone sequences of the input text or recognized text for synthesized speech or recordings. On signal level, the detection is based on the fundamental frequency (f0) compare for the consistent of the synthesized speech and the corresponding recordings inside the phones. The phone segment information is based on the HTK forced alignment of the recognized phone sequence and the input speech signals. According to an embodiment, the f0 is computed using RAPT as described by David Talkin in "A robust algorithm for pitch tracking (RAPT)" in Speech Coding and Syntheis in 1995. The similarity on signal level is measured by the detectable of f0 in a normal range, such as 50 Hz to 500 Hz includes the acoustic models (234, 266) both for TTS and SR, and also has relationship with the lexicons (or pronunciation dictionary) 232, 268. A difference of this level from the text or signal level processing is a time definition property. At this level, phone sequence evaluation 270 checks the similarity of TTS and SR phone sets, including the mapping relations. When a phone is different from TTS to SR in their phone sets respectively, lexicon checker 272 is used for the phone mapping. According to an embodiment, the unification of the phone sets for the TTS and the SR by the SRAE framework 200 is performed one time and not checked again.

Pronunciation issue detector 26 processes results of the comparisons from each level within SRAE framework 200. Pronunciation issue detector 26 receives results (similarity results) from phone sequence evaluator 270 and filters out the matched phone labels of the recognized result of the synthesized speech and its corresponding recordings. Pronunciation issue detector 26 analyzes the signal level consistent labels received from evaluator 244 for the checked phones filtered out above and the pronunciation issue detector 26 filters out the signal level issues. Pronunciation issue detector 26 receives word level similarity measure results from top end evaluator 210 and filters out the mismatched word for the judgment labels of the recognized result of the synthesized speech and its corresponding recordings as the pronunciation issues. Pronunciation issue detector 26 also calculates the segment breaker and the sentence level potential issue count based on the word level judgment labels. According to an embodiment, the potential issue count for the mismatch words on each sentence between the recognized synthesized speech and the recordings excludes the ones caused by the recognizer errors which have the same recognized text on the synthesized speech and the corresponding recordings.

Results 280 is the result determined by pronunciation issue detector 26. According to an embodiment, results 280 is a ranking list that includes a potential pronunciation issue candidates ranking by the detected issue counts on each sentence in the whole candidate set based on the score s calculated by Eq. (1) shown above and the signal level judgment result on the multi-level analysis. The list includes the sentences which have the detected issue counts above zero.

The following experimental results are provided for illustration purposes and are not intended to be limiting.

In one experiment, 500 synthesized sentences (average sentence length of 15 words) for a female voice were generated and evaluated by the calculation on hit ratios for precision. Among the 500 synthesized sentences, 158 sentences include pronunciation issues as detected by a human language expert. The test set includes the synthesized speech for the 500 sentences as well as the corresponding human recordings for the 500 sentences. SRAE framework 200 uses the test set and automatically determined results comprising lists of the sentences which are detected as the pronunciation issue candidates. A baseline tool was also run on the test set to generate comparison data (e.g. as described by L. F. Wang, L. J. Wang, Y. Teng, Z. Geng, and F. K Soong, "Objective intelligibility assessment of text-to-speech system using template constrained generalized posterior probability," in *Inter-Speech,* 2012). A human language expert also was used in the experiment.

The SRAE framework selected 214 sentences for the list which contains more than one issue as the output. The baseline tool selected 85 sentences. The experiment is measured by the precision of segment hit ratio in table 1 (shown below), which is independent on the sentence number in checking list for random selection. The experiment also measured by the recall ratio for the sentences with pronunciation issues based on the 214 candidate sentences in checking lists, for comparing on proposed SRAE and random selection.

TABLE 1

Experimental results on 500 sentences

| | Random Selection (R.) | | Baseline (B.) | Proposed SRAE (S.) | Relative Improvement 1) S. to B. 2) S. to R. 3) B. to R. |
|---|---|---|---|---|---|
| Sentence count (#) | 85 | 214 | 85 | 214 | NA |
| Segment hit ratio (%) | 6.7 | 6.7 | 8.2 | 21.5 | 1) +162.2<br>2) +220.9<br>3) +22.4 |

In table 1, segment refers to the continuous words who have the same judgment labels with their neighbors. "NA" means no information was available for the calculation item. The results in table 1 show that the relative improvement is 220.9% on precision of pronunciation issue segment hit ratio in the checking list generated by the SRAE framework as described herein compared with a random selection strategy; and 162.2% compared with the baseline. As illustrated, there is a 22.4% relative improvement from the baseline to random selection. The precision of pronunciation issue segment hit ratio in the checking list of the SRAE framework described herein is 21.5%, while the random selection strategy is 6.7%. The recall ratio for the pronunciation issue sentence of the SRAE framework with 214 sentences selected in checking list is 53.8%, while the random selection is 42.8% with the same amount of sentences selected in the checking list. There is 19.2% relative improvement of the SRAE framework described herein compared with random selection. Therefore, the SRAE system and method described herein may make the labor work on checking the pronunciation issues more effective by using the checking list of the proposed method than the random selection from a large amount of candidates.

Figure 3:
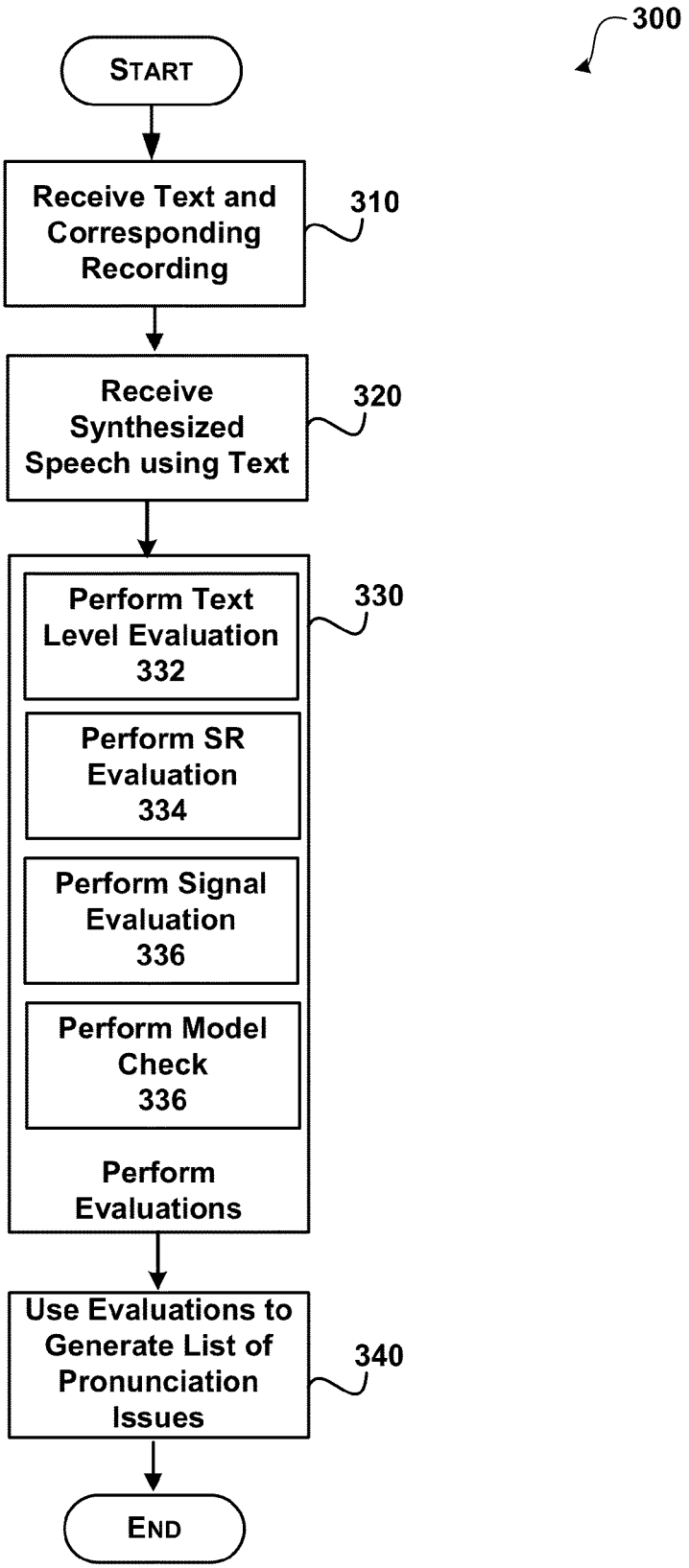
FIG. 3 shows an illustrative process for determining pronunciation issues using text and a recording as a reference.

FIG. 3 shows an illustrative process for determining pronunciation issues using text and a recording as a reference. When reading the discussion of the routines presented herein, it should be appreciated that the logical operations of various embodiments are implemented (1) as a sequence of computer implemented acts or program modules running on a computing system and/or (2) as interconnected machine logic circuits or circuit modules within the computing system. The implementation is a matter of choice dependent on the performance requirements of the computing system implementing the invention. Accordingly, the logical operations illustrated and making up the embodiments described herein are referred to variously as operations, structural devices, acts or modules. These operations, structural devices, acts and modules may be implemented in software, in firmware, in special purpose digital logic, and any combination thereof.

After a start operation, the process moves to operation 310, where text is received and a corresponding recording(s) is received. According to an embodiment, the text is a text script(s) and the recording(s) are human recordings of the text script. The recordings may also include SR phone sequence recordings.

Flowing to operation 320, synthesized speech is received from a TTS component. The TTS component generating the synthesized speech is the TTS component being automatically checked for pronunciation issues.

Moving to decision operation 330, evaluations at different levels are performed. According to an embodiment, evaluations are performed at a text level and a signal level.

At operation 332, text level evaluation (s) are performed. According to an embodiment, the text levels include the word sequence and phone sequence for each sentence within the received text. The comparisons for evaluation on the text include the recognized results of the synthesized speech, the recognized results of the corresponding recordings, and the input text for synthesized speech. The text level evaluation compares a recognized text sequence with reference text sequences, and also compares the recognized text sequences of synthesized speech and recordings both on phone and word levels.

At operation 334, an SR evaluation is performed using results from the SR component that includes results for the synthesized speech as an input and the recording as an input. Comparisons are made between the different results to determine the similarities.

At operation 336, a signal evaluation is performed. The evaluation compares the acoustic features on signal level by comparing the synthesized speech output from TTS flow and the recordings. According to an embodiment, the signal level is based on the phone sequences of the text.

At operation 338, a model check is performed. The model level check compares the acoustic model used by the TTS component and the SR component. The check determines a similarity of a TTS phone set and an SR phone set including determining a mapping relation between the TTS acoustic model and the SR acoustic model.

Flowing to operation 340, a pronunciation issue detector obtains the evaluations performed and generates a list of pronunciation issues.

The process then moves to an end block and returns to processing other actions.

Figure 4:
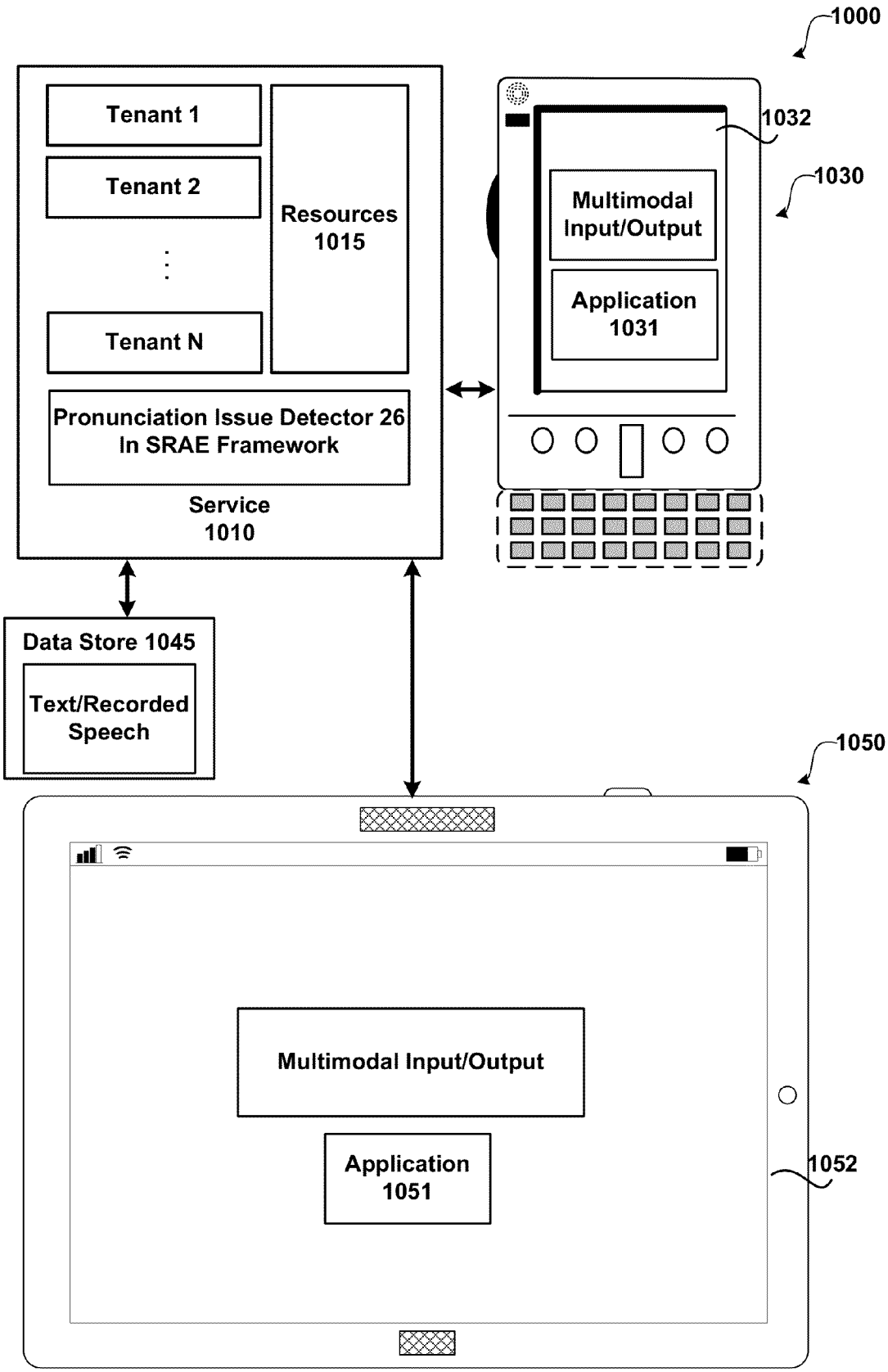
FIG. 4 illustrates an exemplary system using an SRAE framework to detect possible pronunciation issues.

FIG. 4 illustrates an exemplary system using an SRAE framework to detect possible pronunciation issues. As illustrated, system 1000 includes service 1010, data store 1045, touch screen input device/display 1050 (e.g. a slate) and smart phone 1030.

As illustrated, service 1010 is a cloud based and/or enterprise based service that may be configured to provide services that produce multimodal output (e.g. speech, text, . . . ) and receive multimodal input including utterances to interact with the service, such as services related to various applications (e.g. games, browsing, locating, productivity services (e.g. spreadsheets, documents, presentations, charts, messages, and the like)). The service may be interacted with using different types of input/output. For example, a user may use speech input, touch input, hardware based input, and the like. The service may provide speech output that is generated by a TTS component. Functionality of one or more of the services/applications provided by service 1010 may also be configured as a client/server based application.

As illustrated, service 1010 provides resources 1015 and services to any number of tenants (e.g. Tenants 1-N). Multi-tenant service 1010 is a cloud based service that provides resources/services 1015 to tenants subscribed to the service and maintains each tenant's data separately and protected from other tenant data.

System 1000 as illustrated comprises a touch screen input device/display 1050 (e.g. a slate/tablet device) and smart phone 1030 that detects when a touch input has been received (e.g. a finger touching or nearly touching the touch screen). Any type of touch screen may be utilized that detects a user's touch input. For example, the touch screen may include one or more layers of capacitive material that detects the touch input. Other sensors may be used in addition to or in place of the capacitive material. For example, Infrared (IR) sensors may be used. According to an embodiment, the touch screen is configured to detect objects that in contact with or above a touchable surface. Although the term "above" is used in this description, it should be understood that the orientation of the touch panel system is irrelevant. The term "above" is intended to be applicable to all such orientations. The touch screen may be configured to determine locations of where touch input is received (e.g. a starting point, intermediate points and an ending point). Actual contact between the touchable surface and the object may be detected by any suitable means, including, for example, by a vibration sensor or microphone coupled to the touch panel. A non-exhaustive list of examples for sensors to detect contact includes pressure-based mechanisms, micro-machined accelerometers, piezoelectric devices, capacitive sensors, resistive sensors, inductive sensors, laser vibrometers, and LED vibrometers.

According to an embodiment, smart phone 1030 and touch screen input device/display 1050 are configured with multimodal applications (1031, 1051).

As illustrated, touch screen input device/display 1050 and smart phone 1030 shows exemplary displays 1052/1032 showing the use of an application that utilize multimodal input/output (e.g. speech/graphical displays). Data may be stored on a device (e.g. smart phone 1030, slate 1050 and/or at some other location (e.g. network data store 1045). Data store 1054 may be used to store text used by a TTS component, corresponding human recordings of the text and/or models used by a language understanding system. The applications used by the devices may be client based applications, server based applications, cloud based applications and/or some combination.

Pronunciation issue detector 26 is configured to perform operations relating to determining pronunciation issues as described herein. While detector 26 is shown within service 1010, the all/part of the functionality of the detector may be included in other locations (e.g. on smart phone 1030 and/or slate device 1050).

The embodiments and functionalities described herein may operate via a multitude of computing systems, including wired and wireless computing systems, mobile computing systems (e.g., mobile telephones, tablet or slate type computers, laptop computers, etc.). In addition, the embodiments and functionalities described herein may operate over distributed systems, where application functionality, memory, data storage and retrieval and various processing functions may be operated remotely from each other over a distributed computing network, such as the Internet or an intranet. User interfaces and information of various types may be displayed via on-board computing device displays or via remote display units associated with one or more computing devices. For example user interfaces and information of various types may be displayed and interacted with on a wall surface onto which user interfaces and information of various types are projected. Interaction with the multitude of computing systems with which embodiments of the invention may be practiced include, keystroke entry, touch screen entry, voice or other audio entry, gesture entry where an associated computing device is equipped with detection (e.g., camera) functionality for capturing and interpreting user gestures for controlling the functionality of the computing device, and the like.

Figure 5:
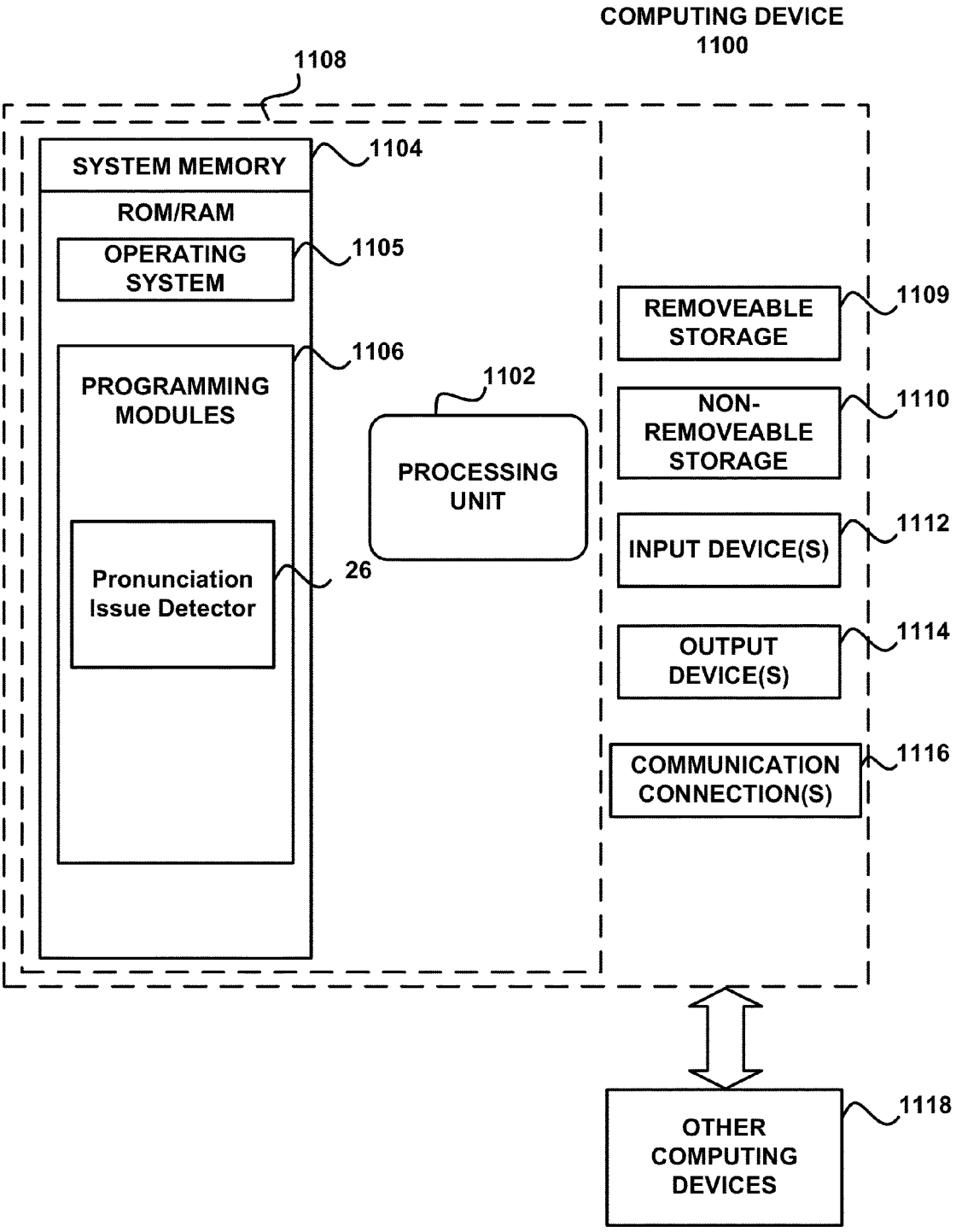
FIGS. 5, 6A, 6B, and 7 and the associated descriptions provide a discussion of a variety of operating environments in which embodiments of the invention may be practiced.
Figure 6A:
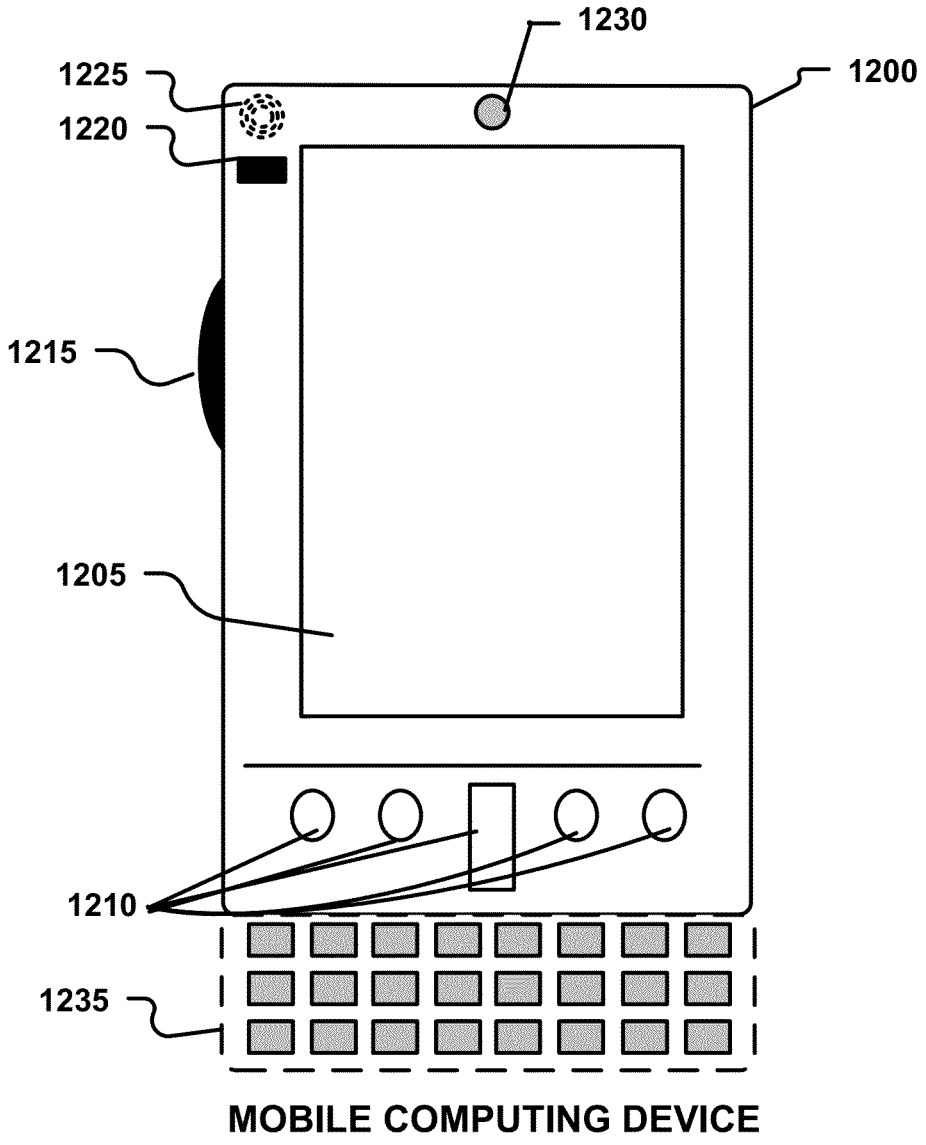
Figure 6B:
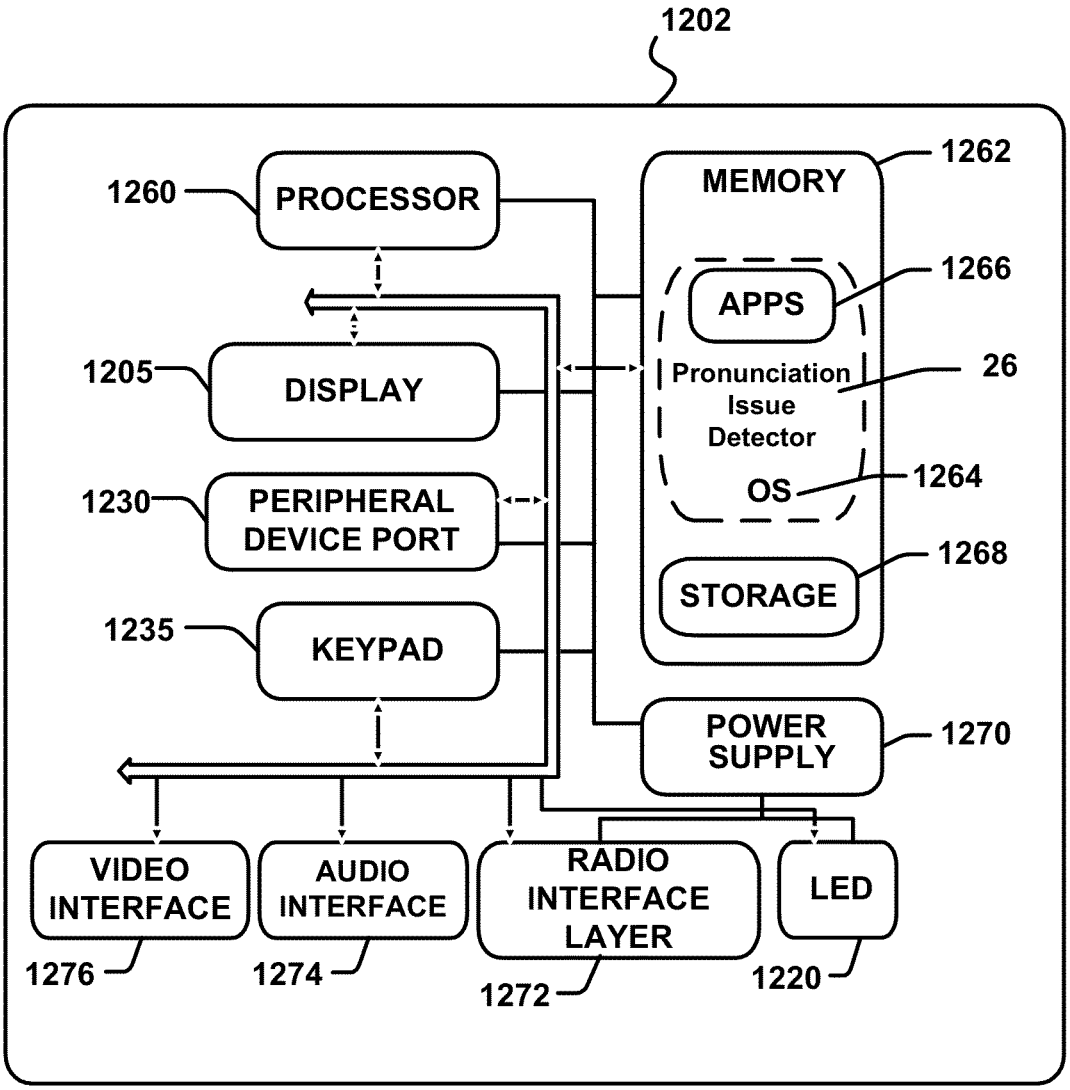
Figure 7:
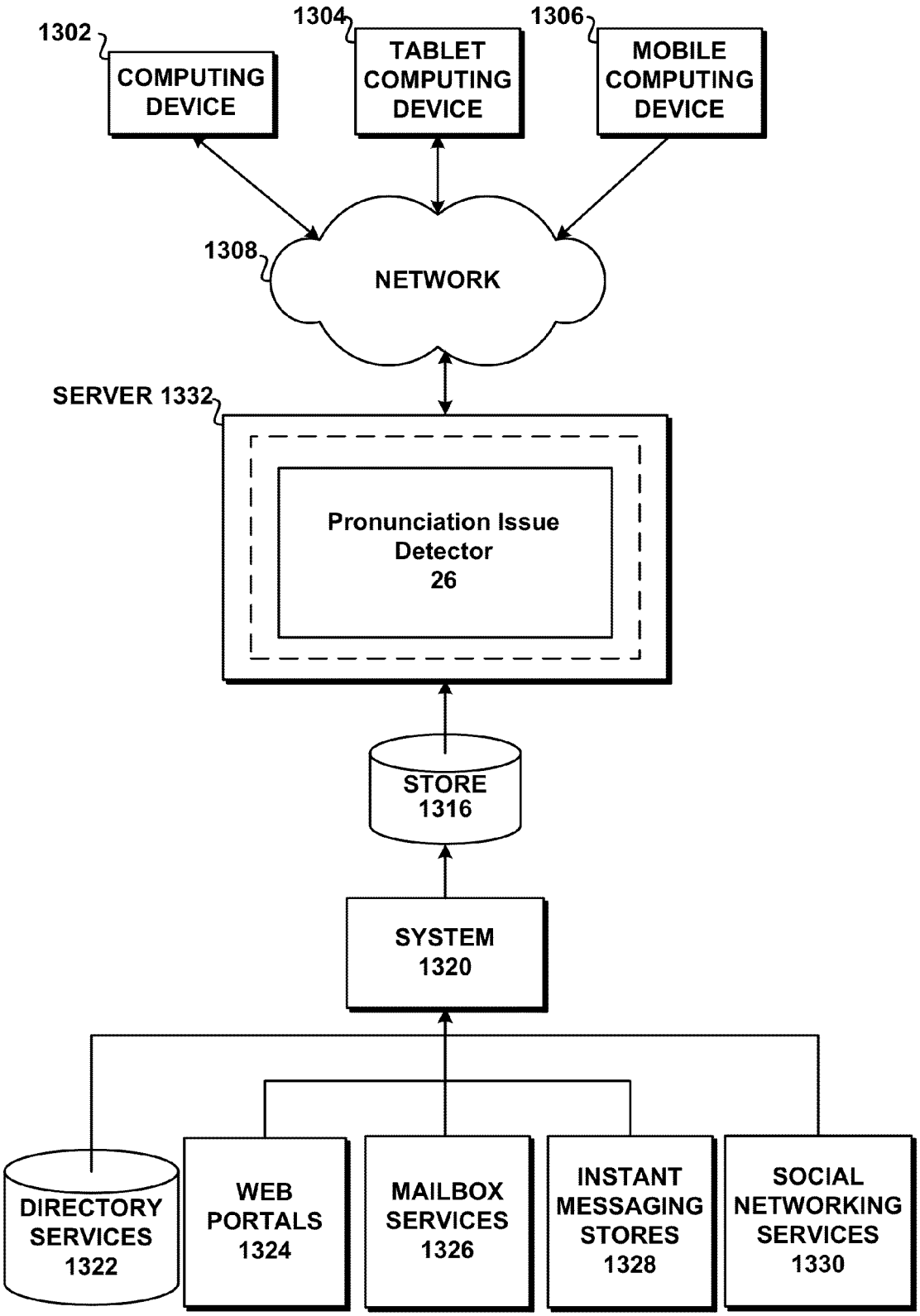

FIGS. 5-7 and the associated descriptions provide a discussion of a variety of operating environments in which embodiments of the invention may be practiced. However, the devices and systems illustrated and discussed with respect to FIGS. 5-7 are for purposes of example and illustration and are not limiting of a vast number of computing device configurations that may be utilized for practicing embodiments of the invention, described herein.

FIG. 5 is a block diagram illustrating example physical components of a computing device 1100 with which embodiments of the invention may be practiced. The computing device components described below may be suitable for the computing devices described above. In a basic configuration, computing device 1100 may include at least one processing unit 1102 and a system memory 1104. Depending on the configuration and type of computing device, system memory 1104 may comprise, but is not limited to, volatile (e.g. random access memory (RAM)), non-volatile (e.g. read-only memory (ROM)), flash memory, or any combination. System memory 1104 may include operating system 1105, one or more programming modules 1106, and may include a web browser application 1120. Operating system 1105, for example, may be suitable for controlling computing device 1100's operation. In one embodiment, programming modules 1106 may include a pronunciation issue detector 26, as described above, installed on computing device 1100. Furthermore, embodiments of the invention may be practiced in conjunction with a graphics library, other operating systems, or any other application program and is not limited to any particular application or system. This basic configuration is illustrated in FIG. 5 by those components within a dashed line 1108.

Computing device 1100 may have additional features or functionality. For example, computing device 1100 may also include additional data storage devices (removable and/or non-removable) such as, for example, magnetic disks, optical disks, or tape. Such additional storage is illustrated by a removable storage 1109 and a non-removable storage 1110.

As stated above, a number of program modules and data files may be stored in system memory 1104, including operating system 1105. While executing on processing unit 1102, programming modules 1106, such as the detector may perform processes including, for example, operations related to methods as described above. The aforementioned process is an example, and processing unit 1102 may perform other processes. Other programming modules that may be used in accordance with embodiments of the present invention may include electronic mail and contacts applications, word processing applications, spreadsheet applications, database applications, slide presentation applications, drawing or computer-aided application programs, etc.

Generally, consistent with embodiments of the invention, program modules may include routines, programs, components, data structures, and other types of structures that may perform particular tasks or that may implement particular abstract data types. Moreover, embodiments of the invention may be practiced with other computer system configurations, including hand-held devices, multiprocessor systems, microprocessor-based or programmable consumer electronics, minicomputers, mainframe computers, and the like. Embodiments of the invention may also be practiced in distributed computing environments where tasks are performed by remote processing devices that are linked through a communications network. In a distributed computing environment, program modules may be located in both local and remote memory storage devices.

Furthermore, embodiments of the invention may be practiced in an electrical circuit comprising discrete electronic elements, packaged or integrated electronic chips containing logic gates, a circuit utilizing a microprocessor, or on a single chip containing electronic elements or microprocessors. For example, embodiments of the invention may be practiced via a system-on-a-chip (SOC) where each or many of the components illustrated in FIG. 5 may be integrated onto a single integrated circuit. Such an SOC device may include one or more processing units, graphics units, communications units, system virtualization units and various application functionality all of which are integrated (or "burned") onto the chip substrate as a single integrated circuit. When operating via an SOC, the functionality, described herein, with respect to the detector 26 may be operated via application-specific logic integrated with other components of the computing device/system 1100 on the single integrated circuit (chip). Embodiments of the invention may also be practiced using other technologies capable of performing logical operations such as, for example, AND, OR, and NOT, including but not limited to mechanical, optical, fluidic, and quantum technologies. In addition, embodiments of the invention may be practiced within a general purpose computer or in any other circuits or systems.

Embodiments of the invention, for example, may be implemented as a computer process (method), a computing system, or as an article of manufacture, such as a computer program product or computer readable media. The computer program product may be a computer storage media readable by a computer system and encoding a computer program of instructions for executing a computer process.

The term computer readable media as used herein may include computer storage media. Computer storage media may include volatile and nonvolatile, removable and non-removable media implemented in any method or technology for storage of information, such as computer readable instructions, data structures, program modules, or other data. System memory 1104, removable storage 1109, and non-removable storage 1110 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1100. Any such computer storage media may be part of device 1100. Computing device 1100 may also have input device(s) 1112 such as a keyboard, a mouse, a pen, a sound input device, a touch input device, etc. Output device(s) 1114 such as a display, speakers, a printer, etc. may also be included. The aforementioned devices are examples and others may be used.

A camera and/or some other sensing device may be operative to record one or more users and capture motions and/or gestures made by users of a computing device. Sensing device may be further operative to capture spoken words, such as by a microphone and/or capture other inputs from a user such as by a keyboard and/or mouse (not pictured). The sensing device may comprise any motion detection device capable of detecting the movement of a user. For example, a camera may comprise a MICROSOFT KINECT® motion capture device comprising a plurality of cameras and a plurality of microphones.

The term computer readable media as used herein may also include communication media. Communication media may be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media.

FIGS. 6A and 6B illustrate a suitable mobile computing environment, for example, a mobile telephone, a smartphone, a tablet personal computer, a laptop computer, and the like, with which embodiments of the invention may be practiced. With reference to FIG. 6A, an example mobile computing device 1200 for implementing the embodiments is illustrated. In a basic configuration, mobile computing device 1200 is a handheld computer having both input elements and output elements. Input elements may include touch screen display 1205 and input buttons 1210 that allow the user to enter information into mobile computing device 1200. Mobile computing device 1200 may also incorporate an optional side input element 1215 allowing further user input. Optional side input element 1215 may be a rotary switch, a button, or any other type of manual input element. In alternative embodiments, mobile computing device 1200 may incorporate more or less input elements. For example, display 1205 may not be a touch screen in some embodiments. In yet another alternative embodiment, the mobile computing device is a portable phone system, such as a cellular phone having display 1205 and input buttons 1210. Mobile computing device 1200 may also include an optional keypad 1235. Optional keypad 1235 may be a physical keypad or a "soft" keypad generated on the touch screen display.

Mobile computing device 1200 incorporates output elements, such as display 1205, which can display a graphical user interface (GUI). Other output elements include speaker 1225 and LED 1220. Additionally, mobile computing device 1200 may incorporate a vibration module (not shown), which causes mobile computing device 1200 to vibrate to notify the user of an event. In yet another embodiment, mobile computing device 1200 may incorporate a headphone jack (not shown) for providing another means of providing output signals.

Although described herein in combination with mobile computing device 1200, in alternative embodiments the invention is used in combination with any number of computer systems, such as in desktop environments, laptop or notebook computer systems, multiprocessor systems, microprocessor based or programmable consumer electronics, network PCs, mini computers, main frame computers and the like. Embodiments of the invention may also be practiced in distributed computing environments where tasks are performed by remote processing devices that are linked through a communications network in a distributed computing environment; programs may be located in both local and remote memory storage devices. To summarize, any computer system having a plurality of environment sensors, a plurality of output elements to provide notifications to a user and a plurality of notification event types may incorporate embodiments of the present invention.

FIG. 6B is a block diagram illustrating components of a mobile computing device used in one embodiment, such as the computing device shown in FIG. 6A. That is, mobile computing device 1200 can incorporate system 1202 to implement some embodiments. For example, system 1202 can be used in implementing a "smart phone" that can run one or more applications similar to those of a desktop or notebook computer such as, for example, presentation applications, browser, e-mail, scheduling, instant messaging, and media player applications. In some embodiments, system 1202 is integrated as a computing device, such as an integrated personal digital assistant (PDA) and wireless phoneme.

One or more application 1266 may be loaded into memory 1262 and run on or in association with operating system 1264. Examples of application programs include phone dialer programs, e-mail programs, PIM (personal information management) programs, word processing programs, spreadsheet programs, Internet browser programs, messaging programs, and so forth. System 1202 also includes non-volatile storage 1268 within memory 1262. Non-volatile storage 1268 may be used to store persistent information that should not be lost if system 1202 is powered down. Applications 1266 may use and store information in non-volatile storage 1268, such as e-mail or other messages used by an e-mail application, and the like. A synchronization application (not shown) may also reside on system 1202 and is programmed to interact with a corresponding synchronization application resident on a host computer to keep the information stored in non-volatile storage 1268 synchronized with corresponding information stored at the host computer. As should be appreciated, other applications may be loaded into memory 1262 and run on the device 1200, including the pronunciation issue detector 26, described above.

System 1202 has a power supply 1270, which may be implemented as one or more batteries. Power supply 1270 might further include an external power source, such as an AC adapter or a powered docking cradle that supplements or recharges the batteries.

System 1202 may also include a radio 1272 that performs the function of transmitting and receiving radio frequency communications. Radio 1272 facilitates wireless connectivity between system 1202 and the "outside world", via a communications carrier or service provider. Transmissions to and from radio 1272 are conducted under control of OS 1264. In other words, communications received by radio 1272 may be disseminated to application 1266 via OS 1264, and vice versa.

Radio 1272 allows system 1202 to communicate with other computing devices, such as over a network. Radio 1272 is one example of communication media. Communication media may typically be embodied by computer readable instructions, data structures, program modules, or other data in a modulated data signal, such as a carrier wave or other transport mechanism, and includes any information delivery media. The term "modulated data signal" means a signal that has one or more of its characteristics set or changed in such a manner as to encode information in the signal. By way of example, and not limitation, communication media includes wired media such as a wired network or direct-wired connection, and wireless media such as acoustic, RF, infrared and other wireless media. The term computer readable media as used herein includes both storage media and communication media.

This embodiment of system 1202 is shown with two types of notification output devices; LED 1220 that can be used to provide visual notifications and an audio interface 1274 that can be used with speaker 1225 to provide audio notifications. These devices may be directly coupled to power supply 1270 so that when activated, they remain on for a duration dictated by the notification mechanism even though processor 1260 and other components might shut down for conserving battery power. LED 1220 may be programmed to remain on indefinitely until the user takes action to indicate the powered-on status of the device. Audio interface 1274 is used to provide audible signals to and receive audible signals from the user. For example, in addition to being coupled to speaker 1225, audio interface 1274 may also be coupled to a microphone to receive audible input, such as to facilitate a telephone conversation. In accordance with embodiments of the present invention, the microphone may also serve as an audio sensor to facilitate control of notifications, as will be described below. System 1202 may further include video interface 1276 that enables an operation of on-board camera 1230 to record still images, video stream, and the like.

A mobile computing device implementing system 1202 may have additional features or functionality. For example, the device may also include additional data storage devices (removable and/or non-removable) such as, magnetic disks, optical disks, or tape. Such additional storage is illustrated in FIG. 9B by storage 1268. Computer storage media may include volatile and nonvolatile, removable and non-removable media implemented in any method or technology for storage of information, such as computer readable instructions, data structures, program modules, or other data.

Data/information generated or captured by the device 1200 and stored via the system 1202 may be stored locally on the device 1200, as described above, or the data may be stored on any number of storage media that may be accessed by the device via the radio 1272 or via a wired connection between the device 1200 and a separate computing device associated with the device 1200, for example, a server computer in a distributed computing network such as the Internet. As should be appreciated such data/information may be accessed via the device 1200 via the radio 1272 or via a distributed computing network. Similarly, such data/information may be readily transferred between computing devices for storage and use according to well-known data/information transfer and storage means, including electronic mail and collaborative data/information sharing systems.

FIG. 7 illustrates a system architecture for a system as described herein.

Components managed via the pronunciation issue detector 26 may be stored in different communication channels or other storage types. For example, components along with information from which they are developed may be stored using directory services 1322, web portals 1324, mailbox services 1326, instant messaging stores 1328 and social networking sites 1330. The systems/applications 26, 1320 may use any of these types of systems or the like for enabling management and storage of components in a store 1316. A server 1332 may provide communications and services relating to determining possible pronunciation issues as described herein. Server 1332 may provide services and content over the web to clients through a network 1308. Examples of clients that may utilize server 1332 include computing device 1302, which may include any general purpose personal computer, a tablet computing device 1304 and/or mobile computing device 1306 which may include smart phones. Any of these devices may obtain display component management communications and content from the store 1316.

Embodiments of the present invention are described above with reference to block diagrams and/or operational illustrations of methods, systems, and computer program products according to embodiments of the invention. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A method for determining pronunciation issues, comprising:

receiving text comprising sentences for a Text-To-Speech (TTS) component and a recording of the text that is used as a reference for the text;

receiving synthesized speech generated by the TTS component using the text as input to the TTS component;

evaluating results received by an evaluation performed at a text level by determining a similarity of the synthesized speech to the recording, wherein the evaluation at the text level comprises performing a similarity measurement of a phone sequence of a sentence in the text and a corresponding phone sequence of a sentence in the recording;

evaluating results obtained from a Speech Recognition (SR) component related to different inputs to the SR component comprising the synthesized speech and the recording; and generating a list that includes a ranking of pronunciation issue candidates based on the evaluations.

2. The method of claim 1, further comprising evaluating results from a signal level evaluation of phone sequences of the text using a phone sequence determined from the TTS component and an SR phone sequence of the recording.

3. The method of claim 1, wherein the evaluation at the text level further comprises performing evaluations for a word sequence and a phone sequence of each sentence within the text.

4. The method of claim 1, further comprising performing a model level check for an acoustic model that determines a similarity of a TTS phone set and an SR phone set including determining a mapping relation between the TTS acoustic model and the SR acoustic model.

5. The method of claim 1, wherein the evaluation performed at the text level comprises determining a similarity using an equation as defined by:

$$s = 1 - \frac{C_{Sub} + C_{Ins}}{C_{Corr} + C_{Sub} + C_{Del}}$$

where s is a similarity score; $C_{Corr}$, $C_{Sub}$, $C_{Ins}$ and $C_{Del}$ denote counts of correct components, substitution errors, insertion errors, and deletion errors in a sentence.

6. The method of claim 1, wherein generating the list that includes the ranking of pronunciation issue candidates comprises filtering out mismatched words for judgment labels based on at least one of the evaluations using the synthesized speech and the recording.

7. The method of claim 1, wherein the results received by the evaluation performed at the text level and the results obtained from the SR component are received by a pronunciation issue detector that is configured to perform the evaluations and to generate the list.

8. A tangible computer-readable storage device storing computer-executable instructions for determining pronunciation issues, comprising:

receiving text comprising sentences for a Text-To-Speech (TTS) component and a recording of the text that is used as a reference for the text;

receiving synthesized speech generated by the TTS component using the text as input to the TTS component;

evaluating results received by an evaluation performed at a text level by determining a similarity of the synthesized speech to the recording;

evaluating results obtained from a Speech Recognition (SR) component related to different inputs to the SR component comprising the synthesized speech and the recording;

evaluating results from a signal level evaluation of the text and the recording; and generating a list that includes a ranking of pronunciation issue candidates based on the evaluations.

9. The tangible computer-readable storage device of claim 8, wherein the signal level evaluation of the text comprises evaluating a similarity of the recording of phone sequences of the text using a phone sequence determined from the TTS component and an SR phone sequence of the recording.

10. The tangible computer-readable storage device of claim 8, wherein the evaluation at the text level comprises performing a similarity measurement of a phone sequence of each sentence in the text and a corresponding phone sequence of each sentence in the recording.

11. The tangible computer-readable storage device of claim 8, further comprising performing a model level check for an acoustic model that determines a similarity of a TTS phone set and an SR phone set including determining a mapping relation between the TTS acoustic model and the SR acoustic model.

12. The tangible computer-readable storage device of claim 8, wherein the evaluation performed at the text level comprises determining a similarity using an equation as defined by:

$$s = 1 - \frac{C_{Sub} + C_{Ins}}{C_{Corr} + C_{Sub} + C_{Del}}$$

where s is a similarity score; $C_{Corr}$, $C_{Sub}$, $C_{Ins}$ and $C_{Del}$ denote counts of correct components, substitution errors, insertion errors, and deletion errors in a sentence.

13. The tangible computer-readable storage device of claim 8, wherein generating the list that includes the ranking of pronunciation issue candidates comprises filtering out mismatched words for judgment labels based on at least one of the evaluations using the synthesized speech and the recording.

14. A system for determining pronunciation issues, comprising:

a processor and memory;

an operating environment executing using the processor;

text comprising sentences and a recording that corresponds to the text;

a Text-To-Speech (TTS) component configured to generate synthesized speech using the text;

a Speech Recognition (SR) component configured to recognize speech; and a pronunciation issue detector that is configured to perform actions comprising:

receiving the synthesized speech generated by the TTS component;

evaluating results received by an evaluation performed at a text level by determining a similarity of the synthesized speech to the recording;

evaluating results obtained from the SR component related to different inputs to the SR component comprising the synthesized speech and the recording;

evaluating results from a signal level evaluation of the text and the recording; and generating a list that includes a ranking of pronunciation issue candidates based on the evaluations.

15. The system of claim 14, wherein the signal level evaluation of the text comprises evaluating a similarity of the recording of phone sequences of the text using a phone sequence determined from the ITS component and an SR phone sequence of the recording.

16. The system of claim 14, wherein the evaluation at the text level comprises performing a similarity measurement of a phone sequence of each sentence in the text and a corresponding phone sequence of each sentence in the recording.

17. The system of claim 14, further comprising performing a model level check for an acoustic model that determines a similarity of a TTS phone set and an SR phone set including determining a mapping relation between the TTS acoustic model and the SR acoustic model.

18. The system of claim 14, wherein the evaluation performed at the text level comprises determining a similarity using an equation as defined by:

$$s = 1 - \frac{C_{Sub} + C_{Ins}}{C_{Corr} + C_{Sub} + C_{Del}}$$

where s is a similarity score; $C_{Corr}$, $C_{Sub}$, and $C_{Del}$ denote counts of correct components, substitution errors, insertion errors, and deletion errors in a sentence.

19. The system of claim 14, wherein generating the list that includes the ranking of pronunciation issue candidates comprises filtering out mismatched words for judgment labels based on at least one of the evaluations using the synthesized speech and the recording.

20. The system of claim 14, wherein the evaluation at the text level comprises performing evaluations for a word sequence and a phone sequence of each sentence within the text.

* * * * *